US006582259B1

(12) United States Patent
Mansson et al.

(10) Patent No.: US 6,582,259 B1
(45) Date of Patent: Jun. 24, 2003

(54) BOAT PROPELLER TRANSMISSION

(75) Inventors: Staffan Mansson, Hjalteby (SE); Oddbjorn Hallenstvedt, Koping (SE)

(73) Assignee: AB Volvo Penta, Gothenburg (SE)

( * ) Notice: Subject to any disclaimer, the term of this patent is extended or adjusted under 35 U.S.C. 154(b) by 0 days.

(21) Appl. No.: 09/868,506

(22) PCT Filed: Dec. 15, 1999

(86) PCT No.: PCT/SE99/02373

§ 371 (c)(1),
(2), (4) Date: Sep. 7, 2001

(87) PCT Pub. No.: WO00/38983

PCT Pub. Date: Jul. 6, 2000

(30) Foreign Application Priority Data

Dec. 16, 1998 (SE) ..... 9804358

(51) Int. Cl.[7] ..... B63H 20/14
(52) U.S. Cl. ..... 440/75; 475/269
(58) Field of Search ..... 440/75, 80, 81; 475/220, 230, 269, 302, 306, 311, 314, 315, 316

(56) References Cited

U.S. PATENT DOCUMENTS 3,164,036 A * 1/1965 Lamburn et al. ..... 475/128
4,173,939 A * 11/1979 Strang ..... 440/75
4,323,354 A * 4/1982 Blanchard ..... 440/75
4,331,432 A * 5/1982 Blanchard ..... 440/75
4,343,612 A 8/1982 Blanchard
4,802,871 A 2/1989 Watanabe et al.
4,850,911 A * 7/1989 Nakahama et al. ..... 440/86
5,711,742 A * 1/1998 Leinonen et al. ..... 477/121
6,200,177 B1 * 3/2001 Scott et al. ..... 440/75
6,350,165 B1 * 2/2002 Neisen ..... 440/75
6,435,923 B1 * 8/2002 Ferguson ..... 440/75
6,439,937 B1 * 8/2002 Mansson et al. ..... 440/75

FOREIGN PATENT DOCUMENTS

WO WO 97/03876 2/1997

* cited by examiner

*Primary Examiner*—S. Joseph Morano
*Assistant Examiner*—Ajay Vasudeva
(74) *Attorney, Agent, or Firm*—Young & Thompson

(57) ABSTRACT

Boat propeller transmission with a horizontal input shaft, a bevel gear set, a vertical intermediate shaft, an additional bevel gear set, and at least one horizontal propeller shaft. Between the bevel gear sets, a two-speed planetary gear set is engaged, to provide two gear speeds in the same direction between the input shaft and the propeller shaft. A control unit controls the shifting between the low and high gear speed. A sensor senses the position of a gear selector. When the gear selector is in the reverse position, the control unit locks the planetary gear set in the high speed position, regardless of the engine speed.

6 Claims, 2 Drawing Sheets

BOAT PROPELLER TRANSMISSION

BRIEF DESCRIPTION OF THE INVENTION

The present invention relates to a boat propeller transmission, comprising an input shaft for connection to an output shaft from a drive installation, intended to be connected to an output shaft from a drive installation, a reversing mechanism driven by said input shaft for reversing the rotational direction of a propeller shaft relative to the rotational direction of the input shaft, and a gear set, providing at least two different gear speeds in the same direction between the input shaft and the propeller shaft.

Boat propeller transmissions, e.g. in propeller drives of the type which are steerably and tiltably mounted on the outside of a boat transom and which are drivably coupled to an inboard engine, usually have one reversing transmission for reversing the rotational direction of the propeller shaft. Recently, however, two-speed propeller drives have been developed for primarily achieving more rapid acceleration so that the boat will more rapidly reach the planing position for better fuel economy. In boats with turbo-charged diesel engines, the poor charging capacity of the turbo unit at low engine rpm has been compensated with a displacement compressor, which is mechanically driven by the engine and which is coupled in series with the turbo compressor and supercharges in the low rpm range of the engine, but which is disconnected as soon as the charging capacity of the turbo compressor exceeds the charging capacity of the displacement compressor. In this manner, rapid acceleration is achieved, so that the planing position can be rapidly reached. With a two-speed propeller drive unit with a low gear and a direct gear, the engine in low gear reached earlier the rpm at which the turbo compressor charges efficiently, which provides more rapid acceleration and earlier planing over a single speed transmission. With a two-speed drive unit it is possible in a boat with an engine only turbo-charged, to achieve approximately the same performance as a boat with a single speed drive unit and an engine with both a turbo compressor and a displacement compressor. The cost of manufacturing a propeller drive unit with an extra gear speed is, however, significantly lower than the extra cost for the displacement compressor installation.

In a transmission known by U.S. Pat. No. 5,711,742, a two-speed gear step is placed in series with the reversing mechanism. The two-speed gear step shifts automatically, depending on engine speed and load. At lower rpm and/or high load, the low gear speed is engaged independently of the position of the reversing mechanism, which in practice means that backing will normally occur at low gear speed, since one seldom backs with the engine at high rpm. Since a propeller is designed to provide optimum pulling force when driving forward in the upper rpm range of the engine, and thus provides significantly lower pulling force when backing and at low rpm, poorer backing performance is provided, firstly due to the reversed rotational direction and, secondly, due to the lower rpm.

SUMMARY OF THE INVENTION

The purpose of the present invention is to achieve a boat propeller transmission of the type described by way of introduction, which can provide better pulling force when backing than what can be achieved with the above described known transmission.

This is achieved according to the invention by virtue of the fact that the gear set is coupled to a control unit, which is connected to a sensor, which senses the position of a gear selector, and that the control unit is disposed, in the reverse position of the gear selector, to lock the gear set in a high gear position, regardless of the rpm. In this way, it is made sure that backing will always occur in the high-gear speed and thus at higher propeller rpm and thus higher propeller pulling force within the lower rpm range of the engine than when backing with the above described known transmission.

BRIEF DESCRIPTION OF THE DRAWINGS

The invention will be described in more detail below with reference to an example shown in the accompanying drawing, where.

DETAILED DESCRIPTION OF THE PREFERRED EMBODIMENTS

Figure 1:
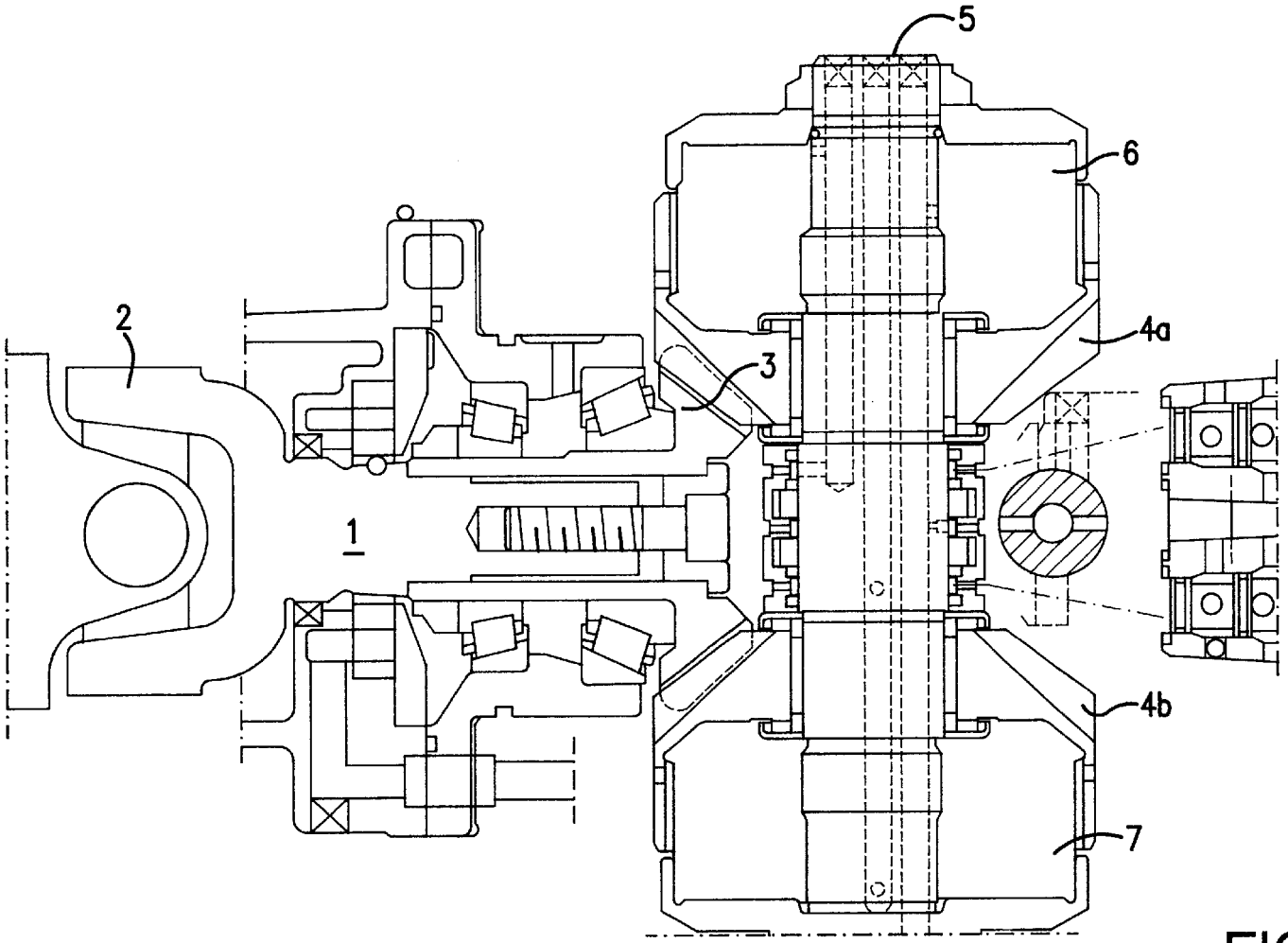
FIG. 1 shows an upper longitudinal section.

The transmission shown in the figures is of the type which, in a single-speed version, is used in steerable and tiltable outboard drives. The transmission shown is used in an outboard drive of the type commercially available under the trademark Aquamatic®. The transmission has an input shaft 1, the outer end of which is joined to a universal knuckle intended to be drivably coupled to the output shaft from an engine. At its inner end, the axle is solidly joined to a bevel gear 3 engaging two bevel gears 4*a* and 4*b*, which are freely rotatably mounted on an intermediate shaft 5, mounted perpendicularly to the input shaft 1. The gears 4*a* and 4*b* can be alternatingly locked to the intermediate shaft 5 with the aid of individual clutches 6 and 7 for driving the intermediate shaft 5 in one direction or the other. These can be hydraulically operated, multi-disc wet-disc clutches.

The lower end of the intermediate shaft 5 is non-rotatably joined to a ring gear 8 in a planetary gear set, generally designated 9. The ring gear engages planet gears 10, which are mounted on a planet gear carrier 11, which is joined to an output shaft 12 from the planetary gear set 9. The planet gears can engage a sun gear 13 made integral with a sleeve 14, through which the output shaft 12 extends. The sleeve 14 is rotatably mounted on the shaft 12 and has an externally threaded portion 15, which engages an internal thread in a bore 16 in a conical clutch element 17 having an external conical frictional surface 18 facing a conical frictional surface 19 of a bore 20 in an end plate 21 of a stationary housing 22. The clutch element 17 forms at the same time an operating piston, and the bore 20 forms a cylinder in which the piston is axially displaceable. The ring gear 8 is made integral with a bowl-shaped carrier 23 of discs 24 arranged alternatingly with discs 25 on the planet gear carrier 11. The carrier 23 also forms a cylinder 26 for a piston 27 by means of which the package of discs 25, 26 can be pressed together to lock the ring gear 8 to the planet gear carrier 11.

The output shaft 12 is joined via splines 28 to an input shaft 29 leading to a bevel gear set formed of three bevel gears 30, 31, 32, of which the gear 30 is joined to the shaft 29 while the gears 31 and 32 are joined to two concentric propeller shafts, thus driven counter-rotationally.

Figure 2:
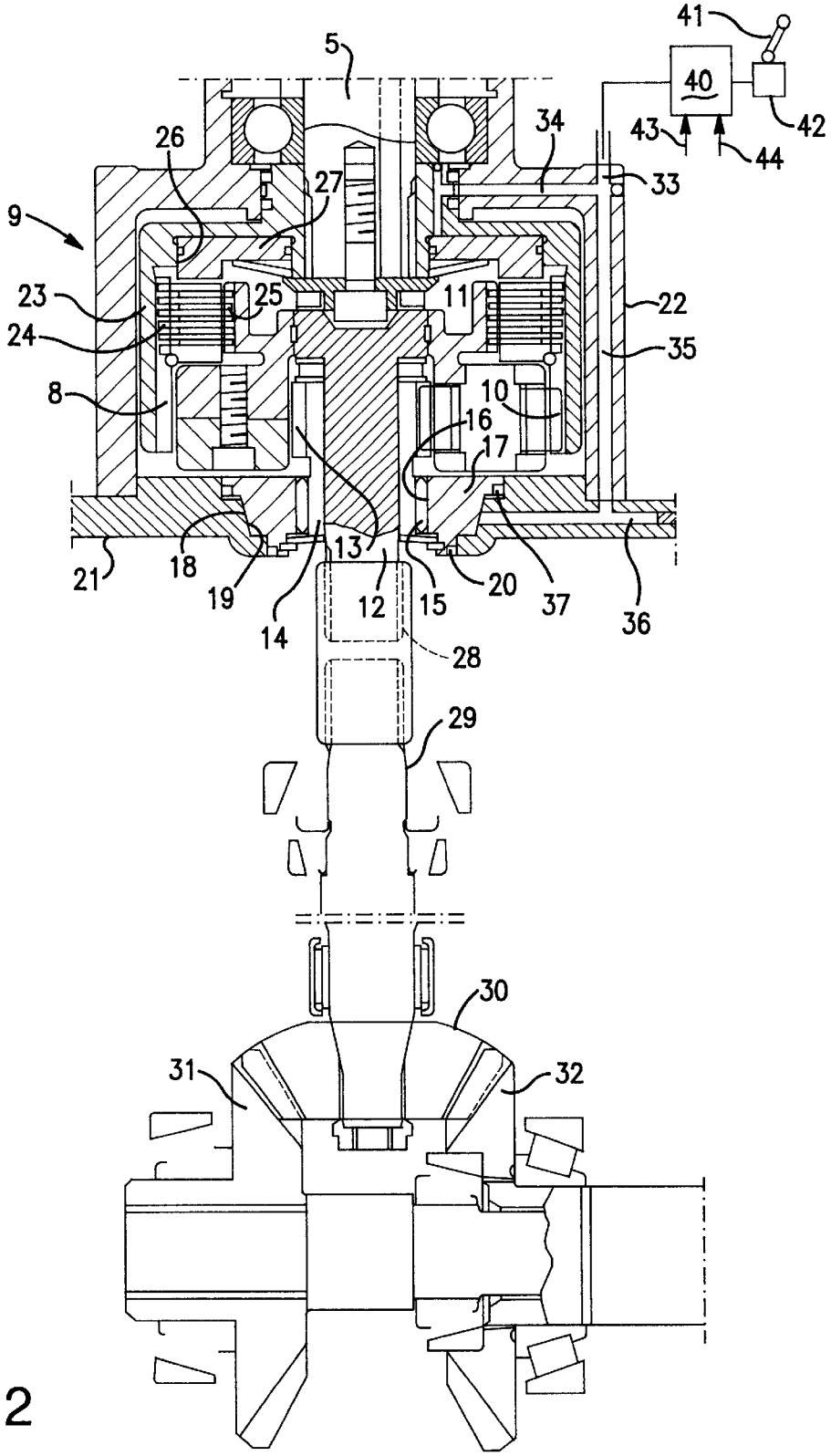
FIG. 2 shows a lower longitudinal section through one embodiment of a boat propeller transmission according to the invention.

In the position shown in FIG. 2 of the components, i.e. with the clutch 25, 26 disengaged and the clutch element 17 and thus also the sun gear 13 locked against rotation, the low gear speed of the planetary gear set is engaged, i.e. the planet gear carrier 11 and the output shaft 12 rotate at a lower rotational speed than the intermediate shaft and the ring gear 8. Sufficiently high friction between the frictional surfaces 18 and 19 for locking the sun gear 13 is thus achieved by virtue of the fact that the thread 15 is so selected in relation to the reactive torque direction against the sun gear 13 when driving forwards that the conical element is affected by a downwardly directed force so that the frictional surfaces 18, 19 are pressed against each other.

In a boat with a turbo-charged diesel engine, with low gear engaged, the rpm at which the charging capacity of the turbo compressor exceeds the capacity of a mechanically driven displacement compressor is rapidly reached. When this rpm has been reached, the higher gear speed (direct drive) is engaged. Shifting is effected by hydraulic fluid under pressure being conducted to an inlet 33 in the planetary gear housing 22. Via channels 34, 35 and 36, the fluid is conducted to the cylinder chamber 26 behind the piston 27 and to a cylinder chamber 37 between the clutch element 17 and the housing end plate 21. From the channel 36, the fluid flows in between the clutch element and the housing end plate by virtue of the fact that the frictional surfaces 18, 19 are profiled so as to provide a certain amount of leakage therebetween. The oil pressure in the cylinder chamber 37 lifts the clutch element 17 so that the sun gear 13 is disengaged from the housing end plate 21. At the same time the oil pressure in the cylinder chamber 26, via the piston 27, presses the package of discs 24, 25 together so that the entire planetary gear unit is locked together as a unit and forms a direct drive connection between the intermediate shaft 5 and the output shaft 12.

In FIG. 2, 40 designates a control unit for automatic shifting between low and high gear speeds in the planetary gear set 9, and 41 designates a shift lever for switching between forward and reverse. The lever 41 is joined to a sensor 42, which senses the position of the lever 41 and provides a position-dependent signal to the control unit. To the control unit there are also fed signals representing engine rpm and load, as indicated by the arrows 43 and 44.

If the lever 41 is moved from its neutral position to a position for driving forward while accelerating to a planing speed, the control unit 40 will engage the low gear speed and shift to the high gear speed at a certain rpm. If the lever 41 is, however, moved from its neutral position to a position for backing, the control unit 40 will engage the high gear speed and lock the transmission in this position, regardless of rpm and load.

What is claimed is:

1. Boat propeller transmission, comprising:

an input shaft intended to be connected to an output shaft from a drive installation;

a reversing mechanism driven by said input shaft for reversing the rotational direction of a propeller shaft relative to the rotational direction of the input shaft; and a gear set providing at least two different gear speeds in the same direction between the input shaft and the propeller shaft, wherein the gear set is coupled to a control unit, which is connected to a sensor, which senses the position of a gear selector, and that the control unit is disposed, in the reverse position of the gear selector, to lock the gear set in a high gear position, regardless of the rpm of the input shaft.

2. Boat propeller transmission according to claim 1, characterized in that the input shaft (1) drives, via a first bevel gear set (3, 4*a*, 4*b*), an intermediate shaft (5), which drives in turn, via a second bevel gear set (30, 31, 32), at least one propeller shaft.

3. Boat propeller transmission according to claim 1, characterized in that the gear set (9) is a two-speed planetary gear set.

4. Boat propeller transmission according to claim 3, characterized in that the input shaft (5) of the planetary gear set (9) non-rotatably supports a ring gear (8), which engages planet gears (10) on a planet gear carrier (11), which is non-rotatably joined to an output shaft (12), which is mounted concentrically with a sun gear (13), that first clutch means (24, 25) are arranged, by means of which the ring gear can be locked to, or be released from, the planet gear carrier, and that second clutch means (17, 19) are arranged, by means of which the sun gear can be locked to or be released from a stationary gear set housing (21, 22).

5. Boat propeller transmission according to claim 4, characterized in that the first clutch means (24, 25) are hydraulically engageable and mechanically disengageable, while the second clutch means (17, 19) are hydraulically disengageable and mechanically engageable, and that the control unit (40) is disposed, with the gear selector in the reverse position, to direct hydraulic fluid to both clutch means, so that the planetary gear set is locked together as a unit and forms a direct connection between the input shaft and the output shaft.

6. Boat propeller transmission according to claim 1, characterized in that it is included in a steerable and tiltable outboard drive intended to be mounted on the outside of a boat transom, and that the input shaft (1) is joined at its outer end to a universal joint (2) intended to be connected to the output shaft from an engine.

* * * * *